US007911307B2

(12) United States Patent
Mast et al.

(10) Patent No.: US 7,911,307 B2
(45) Date of Patent: Mar. 22, 2011

(54) ROTARY TRANSFORMER

(75) Inventors: Jochen Mast, Heidelberg (DE); Jean Schutz, Heidelberg (DE); Jens Helfrich, Speyer (DE); Guntram Scheible, Hirschberg (DE); Colin Luthardt, Vaesteras (SE)

(73) Assignee: ABB Research Ltd, Zurich (CH)

( * ) Notice: Subject to any disclaimer, the term of this patent is extended or adjusted under 35 U.S.C. 154(b) by 1117 days.

(21) Appl. No.: 10/577,556

(22) PCT Filed: Nov. 2, 2004

(86) PCT No.: PCT/EP2004/012360

§ 371 (c)(1),
(2), (4) Date: Oct. 30, 2006

(87) PCT Pub. No.: WO2005/043567

PCT Pub. Date: May 12, 2005

(65) Prior Publication Data

US 2007/0040642 A1 Feb. 22, 2007

(30) Foreign Application Priority Data

Nov. 3, 2003 (DE) ..... 103 51 117

(51) Int. Cl.
*H01F 21/06* (2006.01)

(52) U.S. Cl. ..... 336/130

(58) Field of Classification Search ..... 336/65, 336/117–130, 212, 219, 200
See application file for complete search history.

(56) References Cited

U.S. PATENT DOCUMENTS

| | | | | |
|---|---|---|---|---|
| 3,414,683 | A | 12/1968 | Dolby | |
| 5,677,661 | A * | 10/1997 | Jang | 336/120 |
| 6,008,547 | A | 12/1999 | Dobler et al. | |
| 6,483,218 | B1 * | 11/2002 | Petrinko | 310/112 |
| 7,471,180 | B2 * | 12/2008 | Seong | 336/200 |
| 2003/0179105 | A1 | 9/2003 | Kazmierczak | |

FOREIGN PATENT DOCUMENTS

| | | | |
|---|---|---|---|
| DE | 37 24 349 | A1 | 2/1989 |
| DE | 195 45 220 | A1 | 6/1997 |
| EP | 0 598 924 | B1 | 6/1994 |
| EP | 0 680 060 | A1 | 11/1995 |
| EP | 0 722 811 | A1 | 7/1996 |
| WO | 97/38876 | A1 | 10/1997 |

OTHER PUBLICATIONS

Albert Esser et al., "A New Approach to Power Supplies for Robots", IEEE Transactions on Industry Applications, Sep./Oct. 1991, vol. 27, No. 5, pp. 872-875, XP-000264054 (cited in International Search Report).
Theodor Bödefeld et al., "Elektrische Maschinen", Springer-Verlag, 1965, pp. 50-51 and 56-60.
International Search Report dated Mar. 2, 2005.
German Office Action dated Jul. 23, 2004.

* cited by examiner

*Primary Examiner* — Tuyen Nguyen
(74) *Attorney, Agent, or Firm* — Buchanan Ingersoll & Rooney PC

(57) ABSTRACT

The invention relates to a variable transformer comprising at least one primary winding and at least one secondary winding which can be rotated in relation thereto. The primary winding and the secondary winding are subdivided into at least two winding sections. The winding sections interlock in a comb-like manner and the flow of current of directly opposite winding sections is directed in the respective opposite direction.

20 Claims, 5 Drawing Sheets

ROTARY TRANSFORMER

Figure 1:
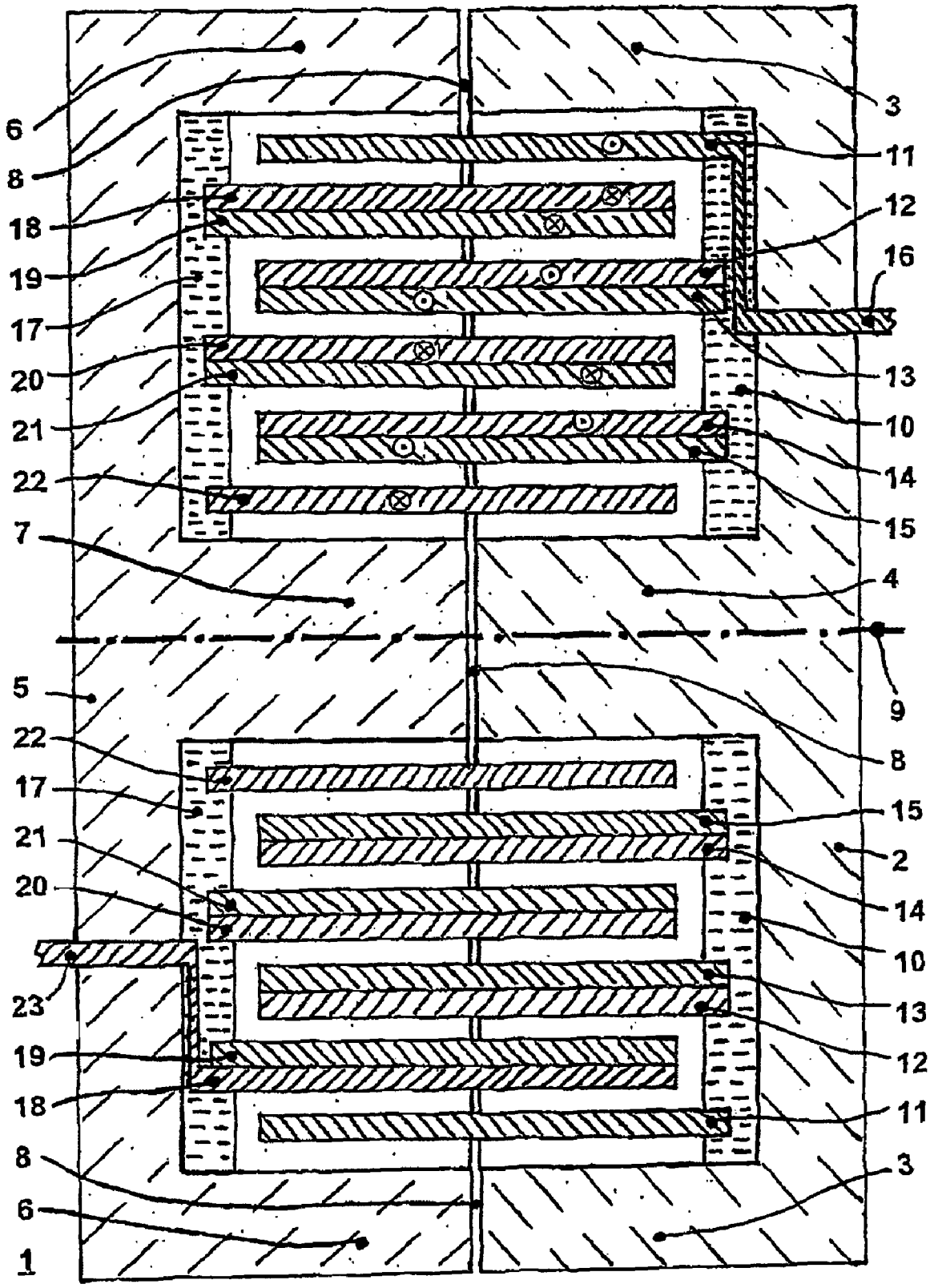

This application is based on and claims priority to German Application No. 103 51 117.2, filed Nov. 3, 2003 and International Application No. PCT/EP2004/012360, filed Nov. 2, 2004 designating the U.S., the entire contents of both of which are hereby incorporated by reference.

The invention relates to a rotary transformer as claimed in the precharacterizing clause of claim 1. The invention can be used, for example, in welding robots.

EP 0 722 811 B1 has disclosed a wireless robot having an apparatus for transmitting electrical power which comprises a rigid core bearing an articulated joint and having a primary winding around a proximal part of a rotary shaft and a rotary core having a secondary winding about a distal part of the rotary shaft, the rigid core being positioned opposite the rotary core in contactless fashion, in order to transmit electrical power from the proximal part to the distal part in contactless fashion by means of electromagnetic radiofrequency induction.

EP 0 598 924 B1 has disclosed a contactless power transmission apparatus for a machine device, in which case power is transmitted from a stationary unit to a rotary unit of the machine device without any direct electrical contact. A split core is used which comprises a first core and a second core, these cores being fixed to the stationary unit and the rotary unit, respectively, and forming a magnetic circuit, whose magnetic path length does not change as a result of any desired rotation of the second core in relation to the first core. A first coil is connected to a radiofrequency AC source and is provided in the stationary unit in order to provide the magnetic circuit with a magnetomotive force. A second coil is connected to a power-receiving apparatus and is fixed to the rotary unit, the second coil being arranged such that it is connected to a magnetic flux which passes through the magnetic circuit.

EP 0 680 060 A1 has disclosed a rotary transformer having an annular stator, which is U-shaped in cross section, and a rotor. The sleeve-shaped primary coil is wound around the inner limb of the stator, while the likewise sleeve-shaped secondary coil conforms to the outer limb of the rotor, with the result that, whilst forming an air gap ensuring that they can move in relation to one another, the primary coil and the secondary coil lie directly opposite one another.

Rotary transformers in accordance with the prior art have distributed windings, i.e. the primary winding and the secondary winding are located in core halves which are separate from one another and in each case do not protrude beyond said core halves. On the one hand, a considerable leakage field is formed, and on the other hand the losses of the rotary transformer are relatively high.

The invention is based on the object of specifying a rotary transformer which has a relatively high degree of efficiency even when subjected to a radiofrequency—for example 25 kHz—and produces a relatively low leakage field.

This object is achieved according to the invention, in conjunction with the features of the precharacterizing clause, by the features specified in the characterizing clause of claim 1.

The advantages which can be achieved by the invention consist in particular in the fact that the skin effects occurring at high frequencies as well as the transformer losses occurring and the leakage field occurring are minimized. This therefore results in a high degree of efficiency for the rotary transformer. The rotary transformer can be reproduced exactly, i.e. the discrepancies in the electrical data occurring during manufacture are extremely slight. The air gap to be formed between the two core halves—important for the two transformer halves to be capable of moving in a rotary fashion freely with respect to one another—can be selected such that it has a relatively large dimension and has a negligible effect on the leakage field produced and the losses produced.

The primary part and the secondary part of the rotary transformer can be used at the same time as DC-isolated "contacts" in the sense of a plug; for example the primary part is located at the free end of one robot arm, which can be fitted with various tool arms. These different tool arms each have the secondary part of the rotary transformer at their end which serves to fix it to the robot arm. It is possible for tools to be replaced in a simple and rapid manner, i.e. for various tool arms to be fitted to the robot arm.

Further advantageous are described in the description below.

Advantageous refinements of the invention are characterized in the dependent claims.

Figure 2:
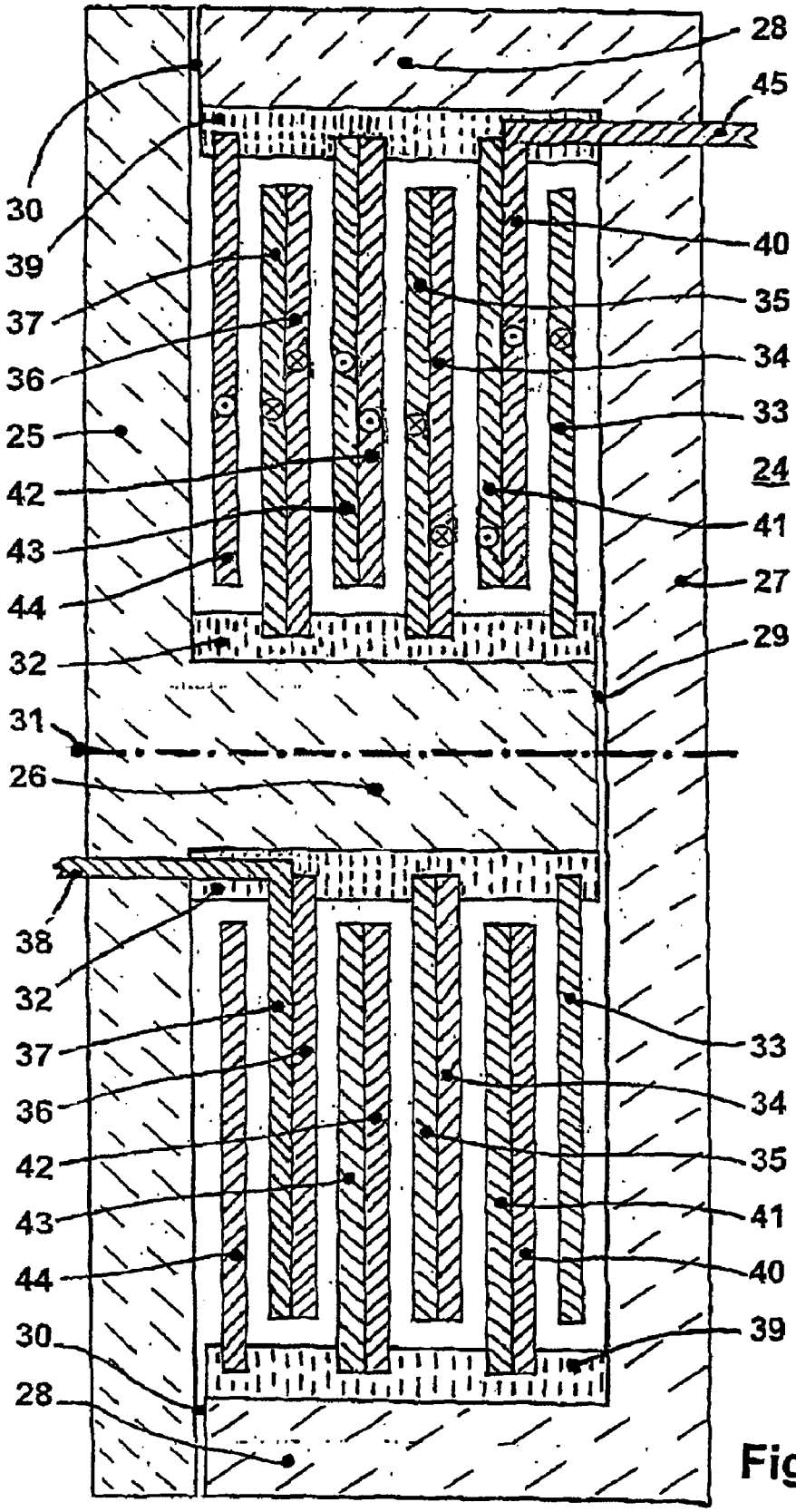
Figure 3:
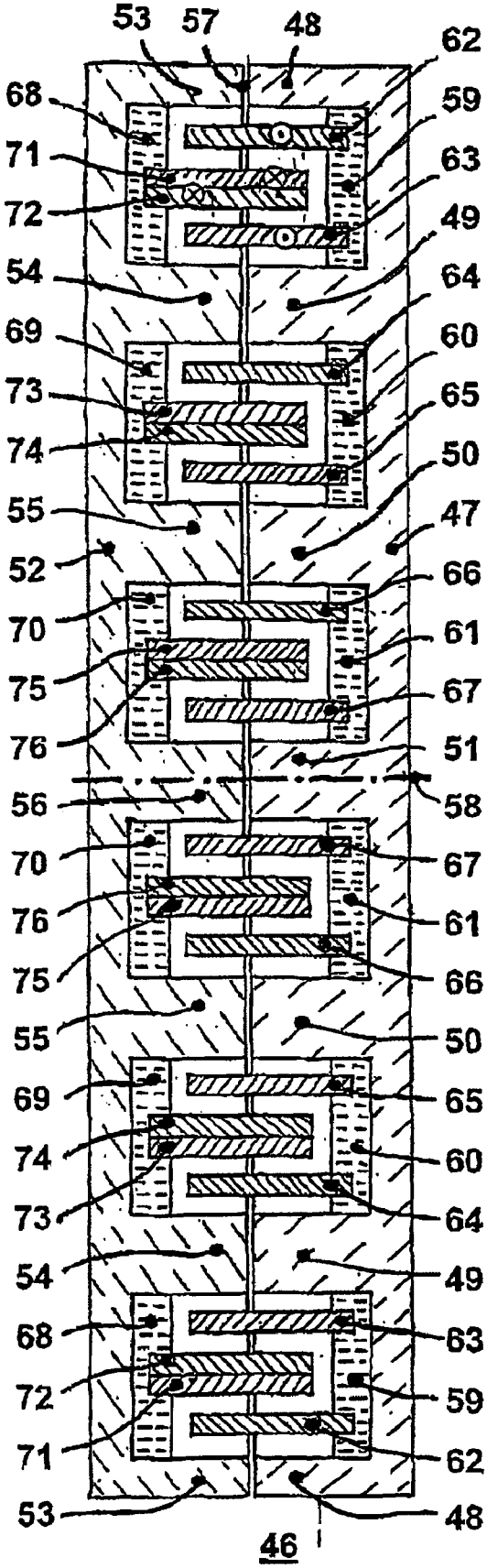
Figure 4:
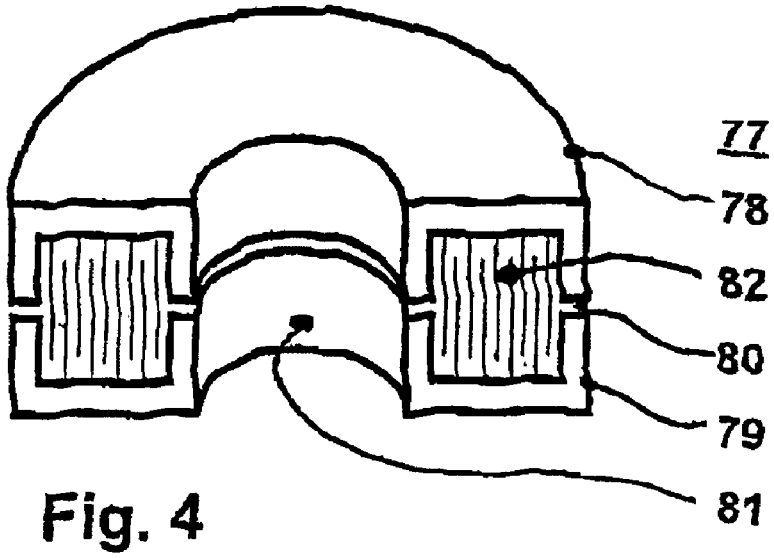
Figure 5:
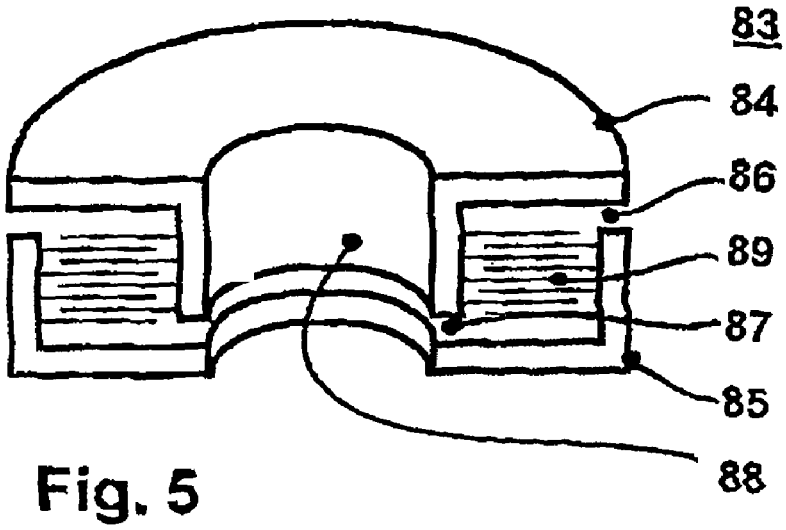
Figure 6:
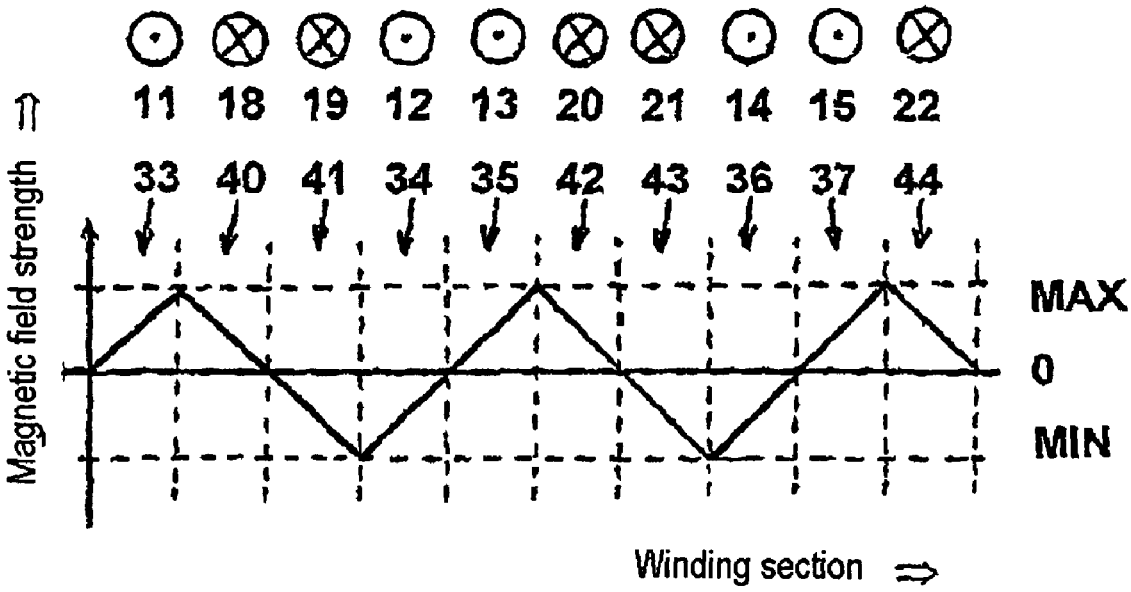

The invention will be explained below with reference to the exemplary embodiments illustrated in the drawing, in which:

FIG. 1 shows a section through a first exemplary embodiment of a rotary transformer having winding sections extending parallel to the axis of rotation, FIG. 2 shows a section through a second exemplary embodiment of a rotary transformer having winding sections extending perpendicularly with respect to the axis of rotation, FIG. 3 shows a section through a third exemplary embodiment of a rotary transformer having a plurality of annular cutouts in the core halves, FIGS. 4, 5 show perspective illustrations of exemplary embodiments with a central hole in the core, and FIG. 6 shows the course of the magnetic field strength over the individual winding sections.

FIG. 1 shows a first exemplary embodiment of a rotary transformer having winding sections extending parallel to the axis of rotation. In this embodiment, the primary winding and the secondary winding have in each case sleeve-shaped winding sections which interengage in the manner of a comb. This embodiment is advantageous in the case of rotary transformers in which the physical height is intended to be great in comparison to the diameter of the core.

The rotary transformer 1 has two essentially symmetrical core halves, to be precise a first core half having a base plate 2, an outer ring 3 and an inner cylinder 4 as well as a second core half having a base plate 5, an outer ring 6 and an inner cylinder 7. An air gap 8 is formed between the two core halves, with the result that the two core halves can move in rotary fashion with respect to one another about a common axis of rotation 9, which runs in the center of the inner cylinders 4, 7, without coming into contact.

As can clearly be seen in the sectional illustration shown in FIG. 1, the outer rings 3, 6, the inner cylinders 4, 7 and the base plates 2, 5 delimit a single annular cutout which is suitable for accommodating (in each case preferably helical) windings. The individual winding sections of the primary winding and the secondary winding are in this case fixed in circular winding supports, which are in each case made from an electrically insulating material, for example plastic, and are mounted on the inner sides of the base plates. The electrical connections between the individual, in each case sleeve-shaped winding sections run within the winding supports. Each winding has two winding terminations, which are passed to the outside via the winding support and corresponding openings in the base plate.

A winding support 10, which is associated with the primary winding, is fixed to the base plate 2 of the first core half and fixes, for example, five winding sections of a primary winding, to be precise an outer winding section 11, two immediately adjacent central winding sections 12, 13, two immediately adjacent inner winding sections 14, 15.

A winding support 17, which is associated with the secondary winding, is fixed to the base plate 5 of the second core half and fixes five winding sections of a secondary winding, to be precise two immediately adjacent outer winding sections 18, 19, two immediately adjacent central winding sections 20, 21, an inner winding section 22.

A winding termination 16 of the primary winding and a winding termination 23 of the secondary winding can be seen (of course at least two winding terminations are required per winding).

As is identified in FIG. 1, the current directions of the winding sections (which lie directly opposite one another so as to form an air gap and are associated alternately with the primary winding and the secondary winding) 11/18, 19/12, 13/20, 21/14, 15/22 are in each case opposite one another.

FIG. 2 illustrates a second exemplary embodiment of a rotary transformer having winding sections extending perpendicularly with respect to the axis of rotation. In this embodiment, the primary winding and the secondary winding have in each case circular winding sections which interengage in the manner of a comb. This embodiment is advantageous in the case of rotary transformers in which the diameter is intended to be large in comparison to the physical height.

The rotary transformer 24 has two asymmetrical core halves, to be precise a first core half having a base plate 25 and an inner cylinder 26 as well as a second core half having a base plate 27 and an outer ring 28. An air gap 29 is formed between the base plate 27 and the inner cylinder 26, and an air gap 30 is formed between the base plate 25 and the outer ring 28, with the result that the two core halves can move in rotary fashion with respect to one another about a common axis of rotation 31, which runs in the center of the inner cylinder 26, without coming into contact.

As can clearly be seen in the sectional illustration shown in FIG. 2, the outer ring 28, the inner cylinder 26 and the base plates 25, 27 delimit a single annular cutout which is suitable for accommodating (in each case preferably helical) windings. The individual winding sections of the primary winding and the secondary winding are in this case fixed in sleeve-shaped winding supports, which are in each case made from an electrically insulating material, for example plastic, and are mounted on the inner side of the outer ring 28 or the outer side of the inner cylinder 26. The electrical connections between the individual, in each case circular winding sections run within the winding supports. Each winding has two winding terminations, which are passed to the outside via the winding support and corresponding openings in the base plate.

A winding support 32, which is associated with the primary winding, is fixed to the outer side of the inner cylinder 26 of the first core half and fixes, for example, five winding sections of a primary winding, to be precise a winding section 33, two immediately adjacent winding sections 34, 35, two immediately adjacent winding sections 36, 37.

A winding support 39, which is associated with the secondary winding, is fixed to the inner side of the outer ring 28 of the second core half and fixes five winding sections of a secondary winding, to be precise two immediately adjacent winding sections 40, 41, two immediately adjacent central winding sections 42, 43, a winding section 44.

A winding termination 38 of the primary winding and a winding termination 45 of the secondary winding can be seen.

As is identified in FIG. 2, the current directions of the winding sections (which lie directly opposite one another so as to form an air gap and are associated alternately with the primary winding and the secondary winding) 33/40, 41/34, 25/42, 43/36, 37/44 are in each case opposite one another.

FIG. 3 illustrates a third exemplary embodiment of a rotary transformer having a plurality of annular cutouts in the core halves. This embodiment is in principle suitable both for sleeve-shaped winding sections—see FIG. 1—and for circular winding sections—see FIG. 2, but only one embodiment, corresponding to FIG. 1, is shown, with sleeve-shaped winding sections.

The rotary transformer 46 has two essentially symmetrical core halves, to be precise a first core half having a base plate 47, an outer ring 48, two intermediate rings 49, 50 and an inner cylinder 51 as well as a second core half having a base plate 52, an outer ring 53, two intermediate rings 54, 55 and an inner cylinder 56. An air gap 57 is formed between the two core halves, with the result that the two core halves can move in rotary fashion with respect to one another about a common axis of rotation 58, which runs in the center of the inner cylinders 51, 56, without coming into contact.

As can clearly be seen in the sectional illustration in FIG. 3, the outer rings 48, 53, the intermediate rings 49/54, 50/55, the inner cylinders 51/56 as well as the base plates 47/52 delimit three separate and concentrically arranged annular cutouts which are suitable for accommodating (in each case preferably helical) windings. The individual winding sections of the primary winding and the secondary winding are in this case fixed in circular winding supports, which are in each case made from an electrically insulating material, for example plastic, and are mounted on the inner sides of the base plates. The electrical connections between the individual, in each case sleeve-shaped winding sections run within the winding supports. Each winding has two winding terminations, which are passed to the outside via the winding support and corresponding openings in the base plate.

An outer winding support 59, which is associated with the primary winding, is fixed to the base plate 47 of the first core half at the location of the outer annular cutout and fixes two winding sections of a primary winding, to be precise an outer winding section 62, an inner winding section 63.

A central winding support 60, which is associated with the primary winding, is fixed to the base plate 47 of the first core half at the location of the central annular cutout and fixes two winding sections of a primary winding, to be precise an outer winding section 64, an inner winding section 65.

An inner winding support 61, which is associated with the primary winding, is fixed to the base plate 47 of the first core half at the location of the inner annular cutout and fixes two winding sections of a primary winding, to be precise an outer winding section 66, an inner winding section 67.

An outer winding support 68, which is associated with the secondary winding, is fixed to the base plate 52 of the second core half at the location of the outer annular cutout and fixes two immediately adjacent winding sections 71, 72 of a secondary winding.

A central winding support 69, which is associated with the secondary winding, is fixed to the base plate 52 of the second core half at the location of the central annular cutout and fixes two immediately adjacent winding sections 73, 74 of a secondary winding.

An inner winding support 70, which is associated with the secondary winding, is fixed to the base plate 52 of the second core half at the location of the inner annular cutout and fixes two immediately adjacent winding sections 75, 76 of a secondary winding.

As is identified in FIG. 3, the current directions of the winding sections (which lie directly opposite one another so as to form an air gap and are associated alternately with the primary winding and the secondary winding) 62/71, 72/63, 64/73, 74/65, 66/75, 76/67 are in each case opposite one another.

Additional advantages of this embodiment as shown in FIG. 3:

- It is also possible for a plurality of DC-isolated primary windings and secondary windings to be provided, i.e. it is possible for a plurality of circuits to be inductively coupled into one and the same rotary transformer.
- As regards the magnetic flux there is a shortened path length, which reduces the losses and thus increases the degree of efficiency.
- Overall less core material is required for guiding the magnetic flux.
- In comparison to the exemplary embodiments shown in FIG. 1 and FIG. 2, a greater primary/secondary transformation ratio can be selected.

FIGS. 4 and 5 illustrate exemplary embodiments with a central hole in the core, to be precise FIG. 4 essentially corresponds to the embodiment shown in FIG. 1 and FIG. 5 essentially corresponds to the embodiment shown in FIG. 2.

FIG. 4 shows a rotary transformer 77 which has a first core half 78 and a second core half 79, which is formed essentially symmetrically with respect thereto, an air gap 80 being formed between the two core halves, and a central hole 81 being provided in the core halves. A winding system 82, comprising a primary winding and a secondary winding, is located in the annular cutout in the rotary transformer 77, the inner cylinders 4, 7 of the embodiment shown in FIG. 1 being replaced by inner rings in order to implement the desired central hole 81.

FIG. 5 shows a rotary transformer 83 which has a first core half 84 and a second core half 85, air gaps 86, 87 being formed between the two core halves, and a central hole 88 being provided in the core halves. A winding system 89, comprising a primary winding and a secondary winding, is located in the annular cutout in the rotary transformer 83, the inner cylinder 26 of the embodiment shown in FIG. 2 being replaced by an inner ring in order to implement the desired central hole 88.

Where winding sections have been mentioned above, a winding section may alternatively comprise:

a single turn or a plurality of (two, three, four . . . ) turns.

The transformation ratio between the primary winding and the secondary winding is in principle freely selectable.

FIG. 6 shows the profile of the magnetic field strength over the individual winding sections. If one first considers the exemplary embodiment shown in FIG. 1, the magnetic field strength over the winding section 11 increases from 0 to the maximum value MAX, falls to 0 and the minimum value MIN over the winding sections 18 and 19, respectively, increases to 0 and MAX over the winding sections 12 and 13, respectively, falls to 0 and MIN over the winding sections 20 and 21, respectively, increases to 0 and MAX over the winding sections 14 and 15, respectively, and falls to 0 over the winding section 22. An identical profile of the magnetic field strength results over the winding sections 33-40-41-34-35-42-43-36-37-44 in the exemplary embodiment shown in FIG. 2.

Of course, an identical profile for the magnetic field strength is also produced in the exemplary embodiment shown in FIG. 3: 0-MAX-0-MIN-0-MAX-0-MIN-0-MAX-0-MIN-0 over the individual winding sections 62-71-72-63-64-73-74-65-66-75-76-67.

It can easily be seen that this zigzag profile for the magnetic field strength (which occurs in all exemplary embodiments) between a maximum value MAX and a minimum value MIN results from the fact that the winding sections of the primary winding and the secondary winding interengage in the manner of a comb, the current flow of immediately adjacent winding sections of the primary winding and the secondary winding in each case being in the opposite direction. If one were to arrange all of the winding sections of the primary winding next to one another and all of the winding sections of the secondary winding likewise next to one another and the primary winding and secondary winding thus formed opposite one another, as is envisaged in EP 0 680 060 A1, the maximum value of the magnetic field strength of a winding distributed in this manner would be a multiple higher than the maximum value which would be achieved in the arrangement according to the invention with winding sections interengaging in the manner of a comb. As a consequence, on the one hand the transformer losses occurring and on the other hand the leakage field occurring would be a multiple greater. This would thus result in a relatively low degree of efficiency for the rotary transformer.

In the above embodiments, it has been assumed by way of example that the primary winding and the secondary winding of the rotary transformer are designed for the same power rating. As a deviation from this, embodiments can of course be realized in which the secondary winding of the rotary transformer is designed to have a lower power capacity than the primary winding and is also correspondingly designed to be lighter if only relatively low powers are to be produced on the secondary side. In such an embodiment, the core half of the secondary part can be dispensed with entirely. This embodiment is very advantageous in particular when using the rotary transformer in a robot having a tool replacement device. A tool replacement device allows for various tool arms to be fitted to the robot arm. The various tools have different power consumptions. The secondary sides of the rotary transformer are in each case matched to the specific power requirement of the tool, while the primary side of the rotary transformer remains the same for all different tools (with different power requirements).

In the above embodiments, it has been assumed that the core halves are each of integral design. As a deviation from this, it is also possible, of course, for the core halves or the core to comprise individual segments (for example in the form of "cake slices").

LIST OF REFERENCE SYMBOLS

1 Rotary transformer
2 Base plate of the first core half
3 Outer ring
4 Inner cylinder
5 Base plate of the second core half
6 Outer ring
7 Inner cylinder
8 Air gap
9 Axis of rotation
10 Winding support of the first core half
11 First winding section of the primary winding
12 Second winding section
13 Third winding section

14 Fourth winding section
15 Fifth winding section
16 Winding termination
17 Winding support of the second core half
18 First winding section of the secondary winding
19 Second winding section
20 Third winding section
21 Fourth winding section
22 Fifth winding section
23 Winding termination
24 Rotary transformer
25 Base plate of the first core half
26 Inner cylinder
27 Base plate of the second core half
28 Outer ring
29 Air gap
30 Air gap
31 Axis of rotation
32 Winding support of the first core half
33 First winding section of the primary winding
34 Second winding section
35 Third winding section
36 Fourth winding section
37 Fifth winding section
38 Winding termination
39 Winding support of the second core half
40 First winding section of the secondary winding
41 Second winding section
42 Third winding section
43 Fourth winding section
44 Fifth winding section
45 Winding termination
46 Rotary transformer
47 Base plate of the first core half
48 Outer ring
49 Intermediate ring
50 Intermediate ring
51 Inner cylinder
52 Base plate of the second core half
53 Outer ring
54 Intermediate ring
55 Intermediate ring
56 Inner cylinder
57 Air gap
58 Axis of rotation
59 Winding support of the first core half
60 Winding support
61 Winding support
62 First winding section of the primary winding
63 Second winding section
64 Third winding section
65 Fourth winding section
66 Fifth winding section
67 Sixth winding section
68 Winding support of the second core half
69 Winding support
70 Winding support
71 First winding section of the secondary winding
72 Second winding section
73 Third winding section
74 Fourth winding section
75 Fifth winding section
76 Sixth winding section
77 Rotary transformer
78 First core half
79 Second core half
80 Air gap
81 Central hole
82 Winding system
83 Rotary transformer
84 First core half
85 Second core half
86 Air gap
87 Air gap
88 Central hole
89 Winding system

The invention claimed is:

1. A rotary transformer comprising:

at least one primary winding and at least one secondary winding which are configured to move in rotary fashion with respect thereto, wherein:

the primary winding and the secondary winding are each divided into at least two separate winding sections, which interengage in the manner of a comb; and the winding sections are arranged such that the current flow of adjacent winding sections among the primary and secondary windings, which lie directly opposite one another so as to form an air gap between the adjacent winding sections, is in the opposite direction between the adjacent winding sections.

2. The rotary transformer as claimed in claim 1, wherein the winding sections extend parallel to the axis of rotation of the rotary transformer and are in the form of sleeves.

3. The rotary transformer as claimed in claim 1, wherein the winding sections extend perpendicularly with respect to the axis of rotation of the rotary transformer and are circular.

4. The rotary transformer as claimed in claim 1, comprising:

two core halves which are configured to move in rotary fashion with respect to one another and form at least one annular cutout for accommodating the primary winding and the secondary winding.

5. The rotary transformer as claimed in claim 4, wherein the two core halves are designed to be essentially symmetrical, and each core half comprises a base plate having (i) an integrally formed outer ring and (ii) an integrally formed inner cylinder or an integrally formed inner ring.

6. The rotary transformer as claimed in claim 5, wherein the base plates include at least one integrally formed intermediate ring to provide more than one annular cutout.

7. The rotary transformer as claimed in claim 4, wherein the first core includes has a base plate having an integrally formed inner cylinder or inner ring, and the second core half includes a base plate having an integrally formed outer ring.

8. The rotary transformer as claimed in claim 5, comprising:

circular wining supports which are mounted on the inner sides of the base plates, wherein the individual winding sections are fixed in the circular winding supports.

9. The rotary transformer as claimed in claim 5, comprising:

sleeve-shaped winding supports which are mounted on the outer side of the inner cylinder or inner ring and on the inner side of the outer ring, wherein the individual winding sections are fixed in the sleeve-shaped winding supports.

10. The rotary transformer as claimed in claim 8, wherein the electrical connections between the individual winding sections run in the winding supports.

11. The rotary transformer as claimed in claim 1, wherein winding terminations are passed to outside the rotary transformer via corresponding openings in the base plates.

12. The rotary transformer as claimed in claim 1, wherein at least one of the winding sections comprises a single turn.

13. The rotary transformer as claimed in claim 1, wherein at least one of winding sections comprises a plurality of turns.

14. The rotary transformer as claimed in claim 4, wherein one central hole is respectively provided in each one of the core halves.

15. The rotary transformer as claimed in claim 2, comprising:

two core halves which are configured to move in rotary fashion with respect to one another and form at least one annular cutout for accommodating the primary winding and the secondary winding.

16. The rotary transformer as claimed in claim 3, comprising:

two core halves which are configured to move in rotary fashion with respect to one another and form at least one annular cutout for accommodating the primary winding and the secondary winding.

17. The rotary transformer as claimed in claim 6, comprising:

circular wining supports which are mounted on the inner sides of the base plates, wherein the individual winding sections are fixed in the circular winding supports.

18. The rotary transformer as claimed in claim 7, comprising:

circular wining supports which are mounted on the inner sides of the base plates, wherein the individual winding sections are fixed in the circular winding supports.

19. The rotary transformer as claimed in claim 6, comprising:

sleeve-shaped winding supports which are mounted on the outer side of the inner cylinder or inner ring and on the inner side of the outer ring, wherein the individual winding sections are fixed in the sleeve-shaped winding supports.

20. The rotary transformer as claimed in claim 7, comprising:

sleeve-shaped winding supports which are mounted on the outer side of the inner cylinder or inner ring and on the inner side of the outer ring, wherein the individual winding sections are fixed in the sleeve-shaped winding supports.

* * * * *